US009297383B2

(12) United States Patent
Jin et al.

(10) Patent No.: US 9,297,383 B2
(45) **Date of Patent: *Mar. 29, 2016**

(54) SCROLL COMPRESSOR WITH BACK PRESSURE CHAMBER

(71) Applicant: LG ELECTRONICS INC., Seoul (KR)

(72) Inventors: Honggyun Jin, Seoul (KR); Suchul Kim, Seoul (KR); Kiwon Park, Seoul (KR); Juhwan Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 107 days.

This patent is subject to a terminal disclaimer.

(21) Appl. No.: 13/949,307

(22) Filed: Jul. 24, 2013

(65) Prior Publication Data

US 2014/0271304 A1 Sep. 18, 2014

(30) Foreign Application Priority Data

Mar. 18, 2013 (KR) ..... 10-2013-0028775

(51) Int. Cl.

| | |
|---|---|
| ***F04C 18/02*** | (2006.01) |
| ***F04C 27/00*** | (2006.01) |
| ***F04C 23/00*** | (2006.01) |
| ***F04C 28/26*** | (2006.01) |

(52) U.S. Cl.

CPC ..... *F04C 18/0261* (2013.01); *F04C 18/023* (2013.01); *F04C 18/0215* (2013.01); *F04C 23/008* (2013.01); *F04C 27/005* (2013.01); *F04C 28/26* (2013.01)

(58) Field of Classification Search

CPC ..... F04C 18/0215; F04C 18/023; F04C 18/0261; F04C 27/005; F04C 28/26

See application file for complete search history.

(56) References Cited

U.S. PATENT DOCUMENTS

| | | | | |
|---|---|---|---|---|
| 5,102,316 | A | 4/1992 | Caillat et al. | |
| 5,156,539 | A | 10/1992 | Anderson et al. | |
| RE35,216 | E | 4/1996 | Anderson et al. | |
| 5,674,058 | A | 10/1997 | Matsuda et al. | 417/440 |
| 6,544,016 | B2 | 4/2003 | Gennami et al. | |
| 6,592,346 | B2 | 7/2003 | Bushnell | |

(Continued)

FOREIGN PATENT DOCUMENTS

| | | | |
|---|---|---|---|
| CN | 1378620 | A | 11/2002 |
| CN | 100545456 | C | 9/2009 |

(Continued)

OTHER PUBLICATIONS

European Search Report dated Jun. 5, 2014 (Application No. 14159390.5).

(Continued)

*Primary Examiner* — Mary A Davis

(74) *Attorney, Agent, or Firm* — Ked & Associates LLP

(57) ABSTRACT

An upper back pressure type scroll compressor is provided having a back pressure chamber. The scroll compressor may include a casing, a discharge cover, a main frame, a first scroll supported by the main frame, and a second scroll forming a suction chamber, an intermediate pressure chamber, and a discharge chamber together with the first scroll. The scroll compressor may also include a back pressure plate coupled to the second scroll. The back pressure plate may include a cavity with which the intermediate pressure chamber of the second scroll communicates. The scroll compressor may further include a floating plate movably coupled to the back pressure plate so as to seal an upper portion of the cavity.

39 Claims, 6 Drawing Sheets

(56) References Cited

U.S. PATENT DOCUMENTS

| | | | | |
|---|---|---|---|---|
| 8,037,702 | B2 | 10/2011 | Sato et al. | |
| 9,222,475 | B2 | 12/2015 | Kim et al. | |
| 2005/0265880 | A1 | 12/2005 | Chang et al. | 418/55.5 |
| 2009/0185935 | A1 | 7/2009 | Seibel et al. | 418/55.4 |
| 2010/0254841 | A1 | 10/2010 | Akei et al. | 418/24 |
| 2010/0303659 | A1 | 12/2010 | Stover et al. | 418/24 |
| 2011/0206548 | A1 | 8/2011 | Doepker | |
| 2011/0293456 | A1 | 12/2011 | Seibel et al. | |
| 2012/0107163 | A1 | 5/2012 | Monnier et al. | |
| 2013/0003659 | A1 | 1/2013 | Iwai et al. | |
| 2014/0134031 | A1* | 5/2014 | Doepker et al. | 418/55.1 |
| 2014/0271302 | A1* | 9/2014 | Kim et al. | 418/55.1 |
| 2014/0271306 | A1* | 9/2014 | Kim et al. | 418/55.4 |

FOREIGN PATENT DOCUMENTS

| | | | |
|---|---|---|---|
| CN | 102086865 | A | 6/2011 |
| CN | 102449313 | A | 5/2012 |
| CN | 102454604 | A | 5/2012 |
| CN | 102472273 | A | 5/2012 |
| CN | 102678546 | | 9/2012 |
| CN | 202545247 | U | 11/2012 |
| JP | 05-10701 | U | 2/1993 |
| JP | 07-158570 | A | 6/1995 |
| JP | H10-184568 | A | 7/1998 |
| JP | 4922988 | B2 | 4/2012 |
| KR | 10-2001-0049691 | | 6/2001 |
| KR | 10-2001-0107309 | A | 12/2001 |
| KR | 10-2006-0096377 | A | 9/2006 |
| KR | 10-0834017 | B1 | 6/2008 |
| KR | 10-2011-0010135 | A | 1/2011 |
| KR | 10-2012-0115581 | | 10/2012 |
| KR | 10-1231059 | B1 | 2/2013 |
| WO | WO 01/34979 | A1 | 5/2001 |

OTHER PUBLICATIONS

European Search Report dated Apr. 28, 2014 issued in Application No. 14 15 9448.

European Search Report dated Apr. 30, 2014 issued in Application No. 14 15 9431.

U.S. Office Action issued in U.S. Appl. No. 13/949,327 dated Jul. 30, 2015.

U.S. Quayle Office Action issued in U.S. Appl. No. 13/949,412 dated Jul. 16, 2015.

Chinese Office Action issued in Application No. 201410100494.0 dated Nov. 2, 2015.

Chinese Office Action issued in Application No. 2014101014716 dated Nov. 2, 2015.

Chinese Office Action issued in Application No. 201410100184.9 dated Nov. 16, 2015.

U.S. Final Office Action Issued in co-pending U.S. Appl. No. 13/949,327 dated Jan. 12, 2016.

* cited by examiner

SCROLL COMPRESSOR WITH BACK PRESSURE CHAMBER

CROSS-REFERENCE TO RELATED APPLICATION(S)

This application claims priority to Korean Application No. 10-2013-0028775, filed in Korea on Mar. 18, 2013, the contents of which is incorporated by reference herein in its entirety.

BACKGROUND

1. Field

A compressor, and more particularly, a scroll compressor is disclosed herein.

2. Background

Scroll compressors are known. However, they suffer from various disadvantages.

A scroll compressor refers to a compressor that utilizes a first or orbital scroll having a spiral wrap and a second or fixed scroll having a spiral wrap, the first scroll performing an orbital motion with respect to the second scroll. While the first scroll and the second scroll are engaged with each other in operation, a capacity of a pressure chamber formed therebetween may be reduced as the first scroll performs the orbital motion. Hence, the pressure of a fluid in the pressure chamber may be increased, and the fluid discharged from a discharge opening formed at a central portion of the second scroll.

The scroll compressor performs a suction process, a compression process and a discharge process consecutively while the first scroll performs the orbital motion. Because of operational characteristics, the scroll compressor may not require a discharge valve and a suction valve in principle, and its structure may be simple with a small number of components, thus making it possible to perform a high speed rotation. Further, as the change in torque required for compression is small and the suction and compression processes consecutively performed, the scroll compressor is known to create minimal noise and vibration.

For the scroll compressor, an occurrence of leakage of a refrigerant between the first scroll and the second scroll should be avoided or kept at a minimum, and lubricity (lubrication characteristic) should be enhanced therebetween. In order to prevent a compressed refrigerant from leaking between the first scroll and the second scroll, an end of a wrap portion should be adhered to a surface of a plate portion. On the other hand, in order for the first scroll to smoothly perform an orbital motion with respect to the second scroll, resistance due to friction should be minimized. The relationship between the prevention of the refrigerant leakage and the enhancement of the lubricity is contradictory. That is, if the end of the wrap portion and the surface of the plate portion are adhered to each other with an excessive force, leakage may be prevented. However, in such a case, more friction between the parts may result, thereby increasing noise and abrasion. On the other hand, if the end of the wrap portion and the surface of the plate portion are adhered to each other with less than an adequate sealing force, the friction may be reduced, but the lowering of the sealing force may result in the increase of leakage.

In order to solve such problems, a back pressure chamber having an intermediate pressure between a discharge pressure and a suction pressure may be formed on a rear surface of the first scroll or the second scroll. That is, the first scroll and the second scroll may be adhered to each other with proper force, by forming a back pressure chamber that communicates with a compression chamber having an intermediate pressure, among a plurality of compression chambers formed between the first scroll and the second scroll. With such a configuration, leakage of refrigerant may be prevented and lubricity enhanced.

The back pressure chamber may be positioned on a lower surface of the first scroll or an upper surface of the second scroll. In this case, the scroll compressor with such a back pressure chamber may be referred to as a 'lower back pressure type scroll compressor' or an 'upper back pressure type scroll compressor' for convenience. The structure of the lower back pressure type scroll compressor is simple, and its bypass holes easily formed. However, as its back pressure chamber is positioned on the lower surface of the first scroll, the form and position of the back pressure chamber may change due to the orbital motion. This may cause the first scroll to tilt, resulting in the occurrence of vibration and noise. Further, an O-ring to prevent leakage of compressed refrigerant may be rapidly abraded. The structure of the upper back pressure type scroll compressor is complicated. However, as the back pressure chamber of the upper back pressure type scroll compressor is fixed in form and position, the probability of the second scroll to tilting is low, and sealing for the back pressure chamber is excellent.

Korean Patent Application No. 10-2000-0037517, entitled Method for Processing Bearing Housing And Scroll Machine having Bearing Housing, which corresponds to U.S. Pat. No. 5,156,539 and U.S. Reissue Pat. No. 35,216, all of which are hereby incorporated by reference, discloses an example of such an upper back pressure type scroll compressor. FIG. 1 is a partial cross-sectional view showing an example of an upper back pressure type scroll compressor. The scroll compressor 1 of FIG. 1 may include a first or orbital scroll 30 configured to perform an orbital motion on a main frame 20 fixedly-installed in a casing 10 and a second or fixed scroll 40 engaged with the first scroll 30 to create a plurality of compression chambers upon the orbital motion. A back pressure chamber BP may be formed at an upper portion of the second scroll 40, and a floating plate 60 to seal the back pressure chamber BP may be installed so as to be slidable up and down along an outer circumferential surface of a discharge passage 45. A discharge cover 2 may be installed at an upper surface of the floating plate 60, thereby dividing an inner space of the scroll compressor 1 into a suction space (S) and a discharge space (D). A lip seal (not shown) may be installed between the floating plate 60 and the back pressure chamber BP, so that refrigerant may be prevented from leaking from the back pressure chamber BP.

The back pressure chamber BP may communicate with one of the plurality of compression chambers, and may be at a receiving end of an intermediate pressure from the plurality of compression chambers. With such a configuration, pressure may be applied upward to the floating plate 60, and pressure may also be applied downward to the second scroll 40. If the floating plate 60 moves upward due to the pressure of the back pressure chamber BP, the discharge space D may be sealed as an end of the floating plate 60 contacts the discharge cover 2. In this case, the second scroll 40 may move downward to be adhered to the first scroll 30. With such a configuration, a gap between the second scroll 40 and the first scroll 30 may be effectively sealed.

BRIEF DESCRIPTION OF THE DRAWINGS

Embodiments will be described in detail with reference to the following drawings in which like reference numerals refer to like elements, wherein.

DETAILED DESCRIPTION

Figure 1:
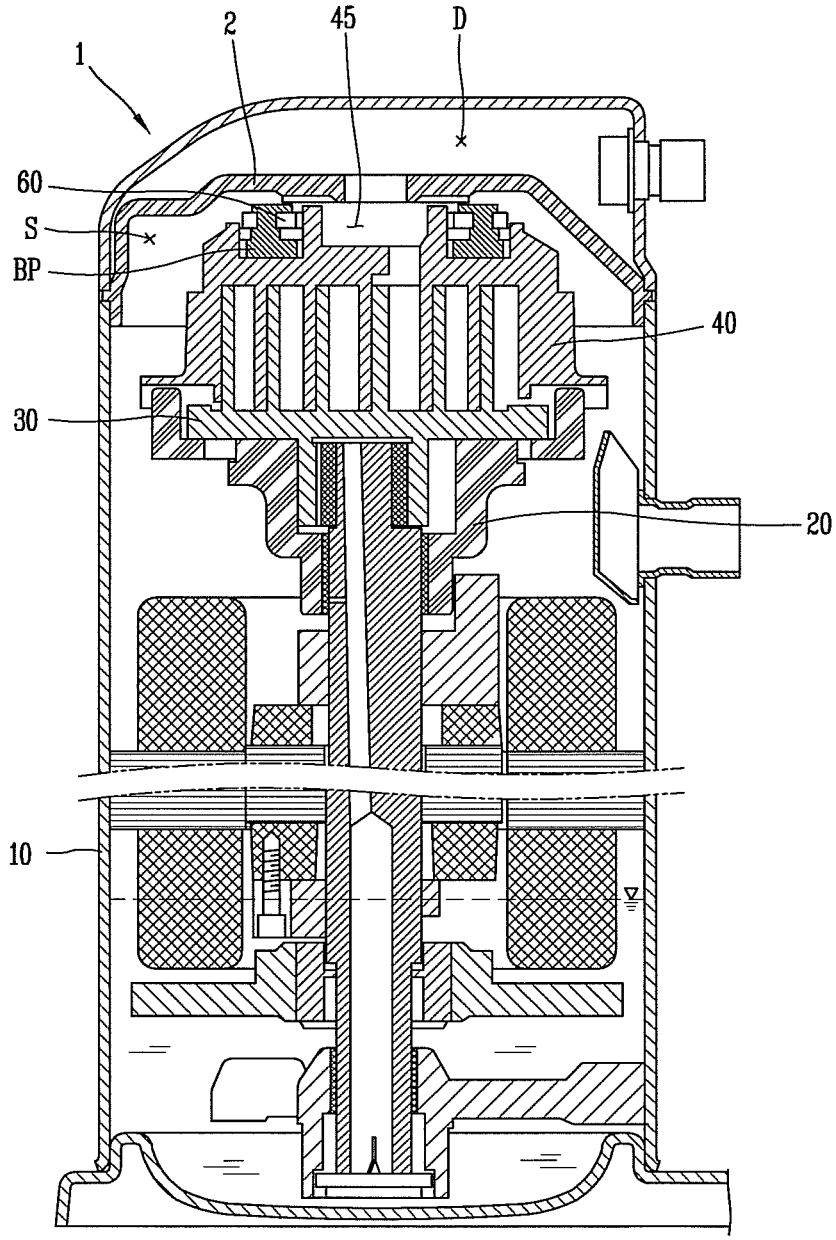
FIG. 1 is a partial cross-sectional view showing an example of an upper back pressure type scroll compressor.

Description will now be given in detail of embodiments, with reference to the accompanying drawings. Where possible, like reference numerals have been utilized to indicate like elements, and repetitive disclosure has been omitted.

Referring to FIG. 1, the floating plate 60 continuously moves up and down while the scroll compressor 1 is operational, in a contacted state to the surface of the back pressure chamber BP. Therefore, high lubricity and high abrasion resistance may be required. The second scroll 40 is manufactured by a casing method, and is formed of cast iron. If the lip seal repeatedly performs a sliding motion along the surface of the second scroll 40, sealing performance may be reduced due to abrasion of the lip seal as the second scroll 40 has a rough surface due to its material. However, due to the structure of the scroll compressor 1, it may be difficult to process the surface roughness of the second scroll 40 to a desired level. Further, the plate portion or the wrap portion of the second scroll 40 may be transformed during the processing of the surface roughness of the second scroll 40.

Therefore, embodiments disclosed herein provide a scroll compressor capable of minimizing abrasion of a leakage preventing device provided at a floating plate. Further, embodiments disclosed herein provide a scroll compressor that may be easily manufactured, and at the same time, minimize deformation of the second scroll during the manufacturing process.

Figure 2:
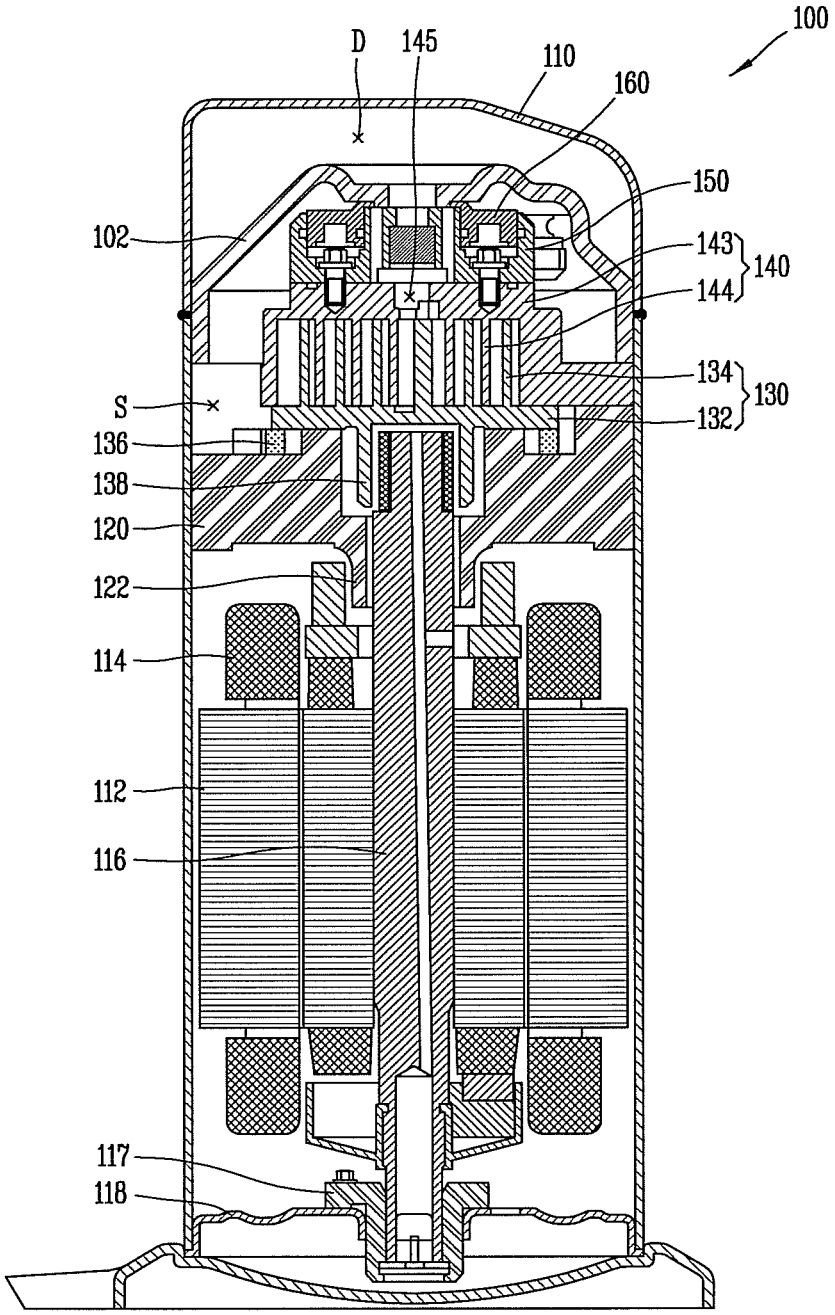
FIG. 2 is a cross-sectional view of an upper back pressure type scroll compressor according to an embodiment.
Figure 3:
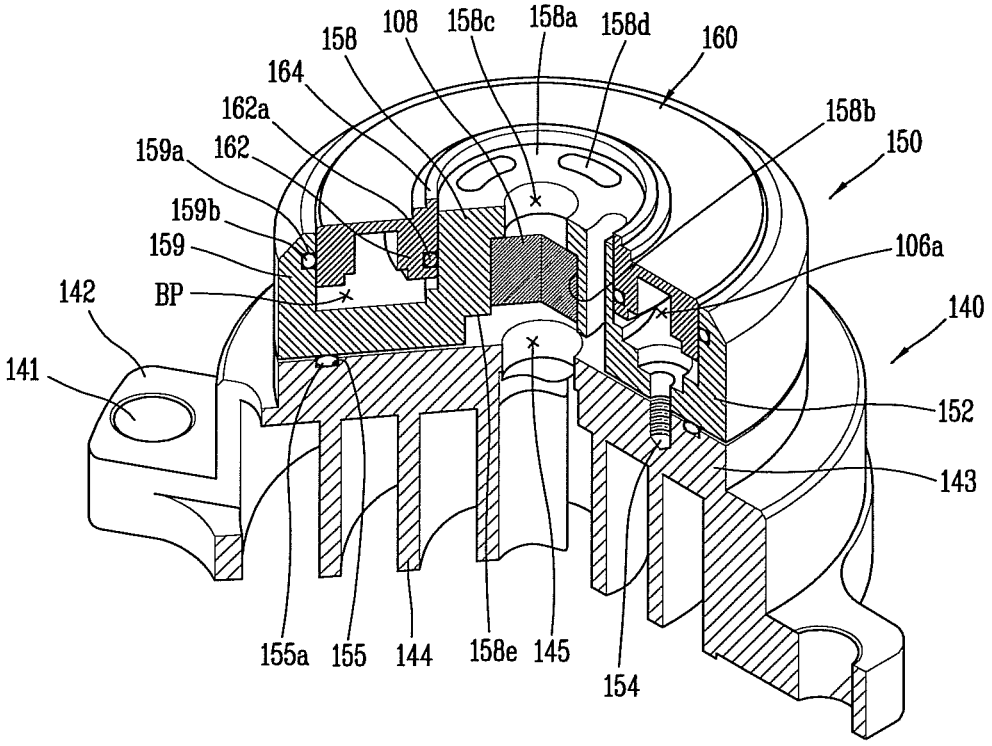
FIG. 3 is a partial cut-out view showing a coupled state between a second scroll and a back pressure plate of the upper back pressure type scroll compressor of FIG. 2.
Figure 4:
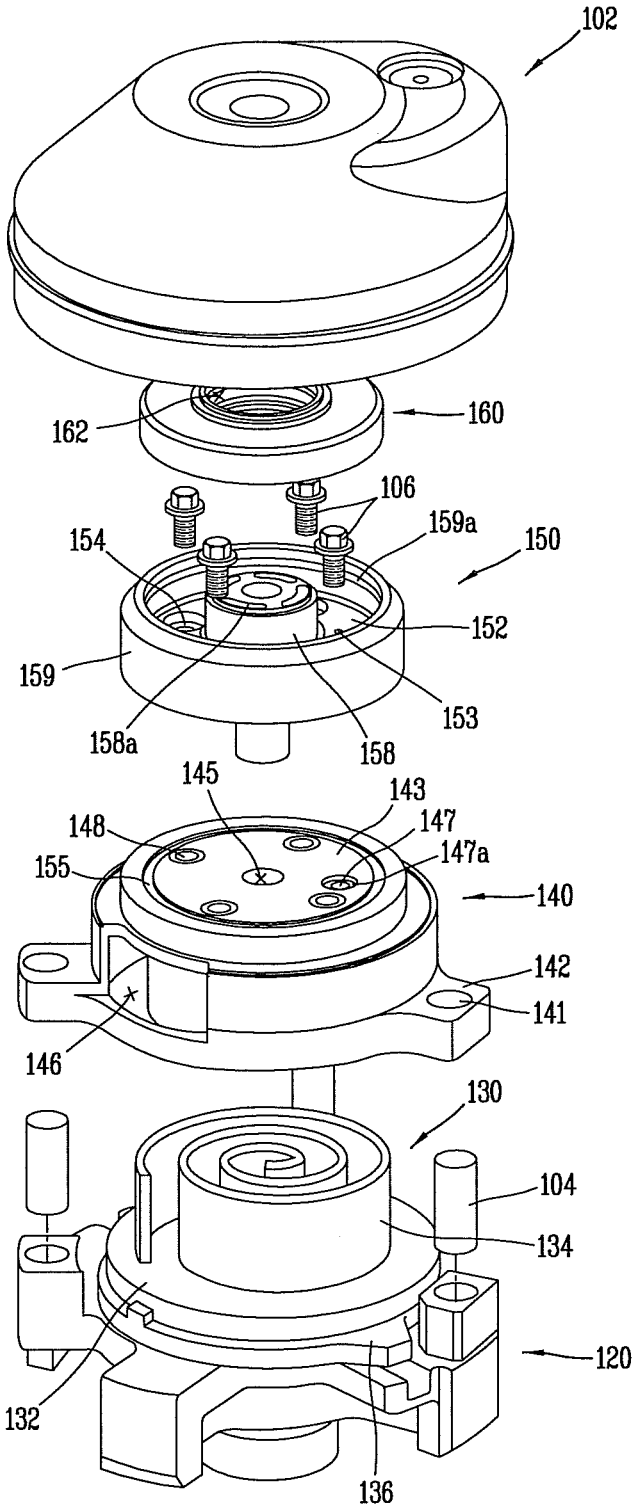
FIG. 4 is an exploded perspective view of the second scroll and the back pressure plate of FIG. 3.
Figure 5:
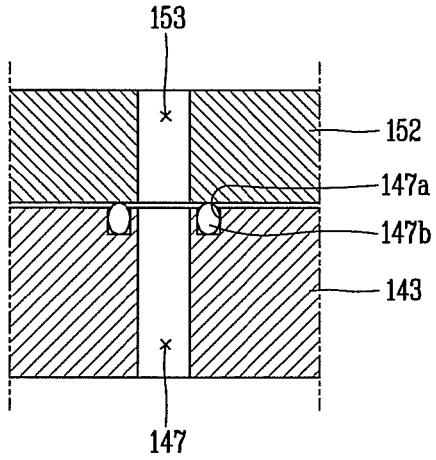
FIG. 5 is an enlarged cross-sectional view showing a portion of the second scroll and the back pressure plate of FIG. 3.
Figure 6:
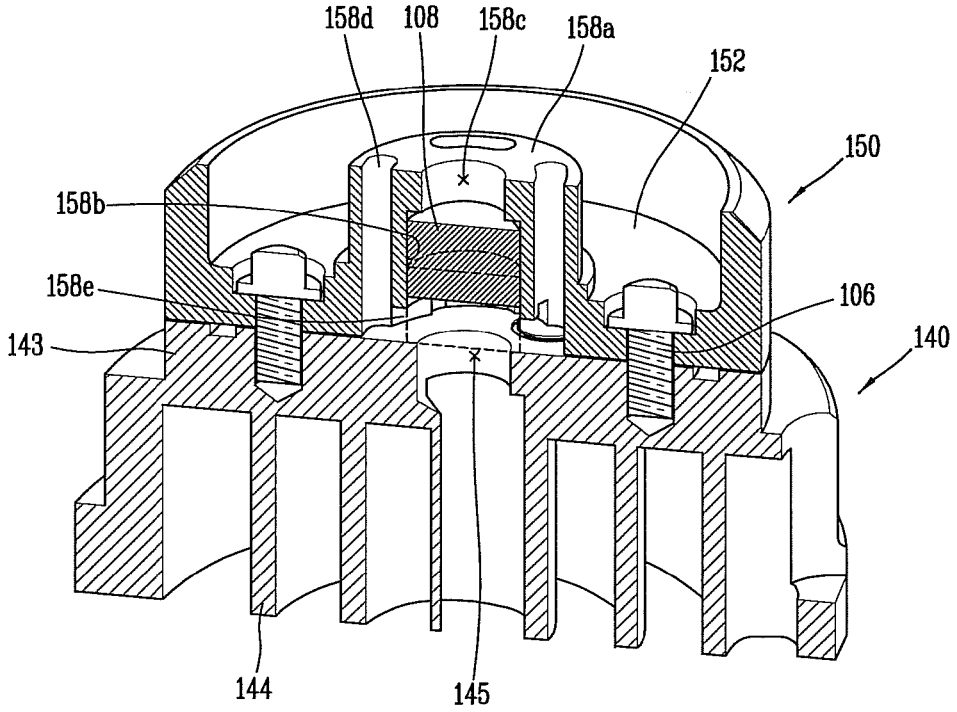
FIG. 6 is a cross-sectional view showing an operation state of a check valve of the back pressure plate of FIG. 3.

FIG. 2 is a cross-sectional view of an upper back pressure type scroll compressor according to an embodiment. FIG. 3 is a partial cut-out view showing a coupled state between a second scroll and a back pressure plate of the upper back pressure type scroll compressor of FIG. 2. FIG. 4 is an exploded perspective view of the second scroll and the back pressure plate of FIG. 3. FIG. 5 is an enlarged cross-sectional view showing a portion of the second scroll and the back pressure plate of FIG. 3. FIG. 6 is a cross-sectional view showing an operation state of a check valve of the back pressure plate of FIG. 3.

Referring to FIG. 2, an upper back pressure type scroll compressor 100 may include a casing 110 having a suction space (S) and a discharge space (D), which are discussed hereinbelow. An inner space of the casing 110 may be divided into the suction space (S) and the discharge space (D) by a discharge cover 102 installed at an upper portion of the casing 110. A space above the discharge cover 102 may correspond to the discharge space (D), and a space below the discharge cover 102 may correspond to the suction space (S). A suction port (not shown) that communicates with the suction space (S) and a discharge port (not shown) that communicates with the discharge space (D) may be fixed to the casing 110, thereby sucking a refrigerant into the casing 110 and discharging a refrigerant to outside of the casing 110, respectively.

A stator 112 and a rotor 114 may be provided below the suction space (S). The stator 112 may be fixed to an inner wall surface of the casing 110, for example, in a shrinkage fitting manner. A rotational shaft 116 may be inserted into a central portion of the rotor 114, and may be rotated by power supplied from outside.

A lower side of the rotational shaft 116 may be rotatably supported by an auxiliary bearing 117 installed at a lower portion of the casing 110. The auxiliary bearing 117 may be supported by a lower frame 118 fixed to an inner surface of the casing 110, thereby stably supporting the rotational shaft 116. The lower frame 118 may be fixed to an inner wall surface of the casing 110, for example, by welding, and a lower surface of the casing 110 may be used as an oil storage space. Oil stored in the oil storage space may be transferred upward via the rotational shaft 116, so that the oil may be uniformly supplied into the casing 110.

An upper end of the rotational shaft 116 may be rotatably supported by a main frame 120. The main frame 120 may be fixed to an inner wall surface of the casing 110, similar to the lower frame 118. A main bearing 122 may protrude downward from a lower surface of the main frame 120, and the rotational shaft 116 may be inserted into the main bearing 122. An inner wall surface of the main bearing 122 may serve as a bearing surface and support the rotational shaft 116 together with the aforementioned oil, so that the rotational shaft 116 may rotate in a smooth manner.

An orbital or first scroll 130 may be disposed on an upper surface of the main frame 120. The first scroll 130 may include a plate portion 132, which may have an approximate disc shape, and a wrap 134 spirally formed on one side surface of the plate portion 132. The wrap 134 may form a plurality of compression chambers together with a wrap 144 of a fixed or second scroll 140, which is discussed hereinbelow. The plate portion 132 of the first scroll 130 may perform an orbital motion while supported by an upper surface of the main frame 120. An Oldham ring 136 may be installed between the plate portion 132 and the main frame 120, and may prevent rotation of the first scroll 130. A boss 138, into which the rotational shaft 116 may be inserted, may be formed on a lower surface of the plate portion 132 of the first scroll 130, thus allowing the first scroll 130 to perform an orbital motion by a rotational force of the rotational shaft 116.

The second scroll 140, which engages the first scroll 130, may be disposed above the first scroll 130. The second scroll 140 may be installed to be movable up and down with respect to the first scroll 130. More specifically, the second scroll 140 may be disposed on an upper surface of the main frame 120 using, for example, a fastener, for example, three guide pins 104, fitted into the main frame 120 inserted into three guide holes 141 formed on an outer circumference of the second scroll 140.

The guide holes 141 may be formed at three pin supporting portions 142 that protrude from an outer circumferential surface of a body portion of the second scroll 140. The number of the guide pins 104 or pin supporting portions 142 may be arbitrarily set, and thus, the number is not limited to three.

The second scroll 140 may include a plate portion 143, which may have a disc shape. The wrap 144, which engages the wrap 134 of the first scroll 130, may be formed below the plate portion 143. The wrap 144 may be formed in a spiral shape, and a discharge opening 145, through which a compressed refrigerant may be discharged, may be formed at a central portion of the plate portion 143. A suction opening 146, through which a refrigerant disposed in the suction space (S) may be sucked, may be formed on a side surface of the second scroll 140 so that the refrigerant may be sucked to the suction opening 146 by an interaction between the wrap 144 and the wrap 134.

As discussed above, the wrap 144 and the wrap 134 form a plurality of compression chambers. As the plurality of compression chambers decrease in volume while orbiting toward the discharge opening 145, a refrigerant is compressed. As a result, a pressure of a compression chamber adjacent to the suction opening 146 may be minimized, and a pressure of a compression chamber that communicates with the discharge opening 145 may be maximized. A pressure of a compression chamber positioned between the above-mentioned two compression chambers is at an intermediate pressure and is halfway between a suction pressure adjacent the suction opening 146 and a discharge pressure adjacent the discharge opening 145. The intermediate pressure may be applied to a back pressure chamber (BP), which is discussed hereinbelow, and press the second scroll 140 toward the first scroll 130. Therefore, an intermediate pressure discharge opening 147, which may communicate with one of the intermediate pressure chambers and through which a refrigerant may be discharged, may be formed at the plate portion 143, referring to FIG. 4.

An intermediate pressure sealing groove 147*a*, in which an intermediate pressure O-ring 147*b* that prevents leakage of a discharged refrigerant at the intermediate pressure may be inserted, may be formed near the intermediate pressure discharge opening 147. The intermediate pressure sealing groove 147*a* may be formed in an approximately circular shape to enclose the intermediate pressure discharge opening 147. However, the shape is not limited to the circular shape. Further, the intermediate pressure sealing groove 147*a* may be formed at other than the plate portion 143 of the fixed scroll 140. For instance, the intermediate pressure sealing groove 147*a* may be formed on a lower surface of a back pressure plate 150, which is discussed hereinbelow.

Bolt coupling holes 148 for coupling bolts 106, which couple the back pressure plate 150 and the second scroll 140, may be formed at the plate portion 143 of the second scroll 140. In this embodiment, the number of the bolt coupling holes 148 is four (4); however, embodiments are not so limited.

The back pressure plate 150 may be fixed to an upper surface of the plate portion 143 of the second scroll 140. The back pressure plate 150 may have a ring shape, and may include a supporting plate 152 that contacts the plate portion 143 of the second scroll 140. The supporting plate 152 may have a ring shape, and may be formed to allow an intermediate pressure suction opening 153, which may communicate with the aforementioned intermediate pressure discharge opening 147, to pass therethrough, referring to FIG. 5. Further, bolt coupling holes 154, which may communicate with the bolt coupling holes 148 of the plate portion 143 of the second scroll 140, may be formed at the supporting plate 152.

An O-ring 155*a* may be disposed between a lower surface of the supporting plate 152 and an upper surface of the second scroll 140. The O-ring 155*a*, which may prevent a refrigerant from leaking from a gap between the supporting plate 152 and the second scroll 140, may be fitted into a ring-shaped groove 155 formed on an upper surface of the second scroll 140. Further, the O-ring 155*a* may be forcibly pressed while the second scroll 140 and the back pressure plate 150 are coupled to each other by the bolts 106, thereby sealing a gap between the second scroll 140 and the back pressure plate 150. Alternatively, the ring-shaped groove 155 may be formed on a lower surface of the supporting plate 152, rather than on the fixed scroll 140.

The back pressure plate 150 may include a first ring-shaped wall 158 and a second ring-shaped wall 159 formed to enclose an inner circumferential surface and an outer circumferential surface of the supporting plate 152, respectively. The first ring-shaped wall 158 and the second ring-shaped wall 159 may form a space having a specific shape together with the supporting plate 152. The space may implement the aforementioned back pressure chamber (BP). The first ring-shaped wall 158 may extend upward from a central portion of the supporting plate 152, and an upper surface 158*a* may cover an upper end of the first ring-shaped wall 158. The first ring-shaped wall 158 may have a cylindrical shape with an open end.

An inner space of the first ring-shaped wall 158 may communicate with the discharge opening 145, thereby implementing a portion of a discharge path along which a discharged refrigerant may be transferred to the discharge space (D). As shown in FIGS. 3 to 5, a check valve 108, which may have a cylindrical shape, may be disposed above the discharge opening 145. More specifically, a lower end of the check valve 108 may be large enough to completely cover the discharge opening 145. With such a configuration, in a case in which the check valve 108 contacts the plate portion 143 of the second scroll 140, the check valve 108 may block the discharge opening 145. The shape of the check valve is not limited to the cylindrical shape, and may include a general reed valve or other shape or type valve.

The check valve 108 may be installed in a valve guide portion 158*b* formed at the inner space of the first ring-shaped wall 158, and the valve guide portion 158*b* may guide an up-and-down motion of the check valve 108. The valve guide portion 158*b* may be formed to pass through the inner space of the first ring-shaped wall 158. An inner diameter of the valve guide portion 158*b* may be the same as an outer diameter of the check valve 108, to guide an up-and-down motion of the check valve 108 above the discharge opening 145. However, the inner diameter of the valve guide portion 158*b* may not be completely equal to the outer diameter of the check valve 108 to facilitate movement of the check valve 108.

A discharge pressure applying hole 158*c* that communicates with the valve guide portion 158*b* may be formed at a central portion of an upper surface of the first ring-shaped wall 158. The discharge pressure applying hole 158*c* may communicate with the discharge space (D). Accordingly, in a case in which a refrigerant from the discharge space (D) backflows to the discharge opening 145, pressure applied to the discharge pressure applying hole 158*c* may become higher than the pressure at the discharge opening 145. As a result, the check valve 108 may move downward to block the discharge opening 145. If the pressure at the discharge opening 145 increases to be higher than the pressure at the discharge space (D), the check valve 108 may move upward to open the discharge opening 145.

One or more intermediate discharge opening(s) 158*d* may be formed outside of the valve guide portion 158*b*. The one or more intermediate discharge opening(s) 158*d* may provide a path through which a refrigerant discharged from the discharge opening 145 may move to the discharge space (D). In this embodiment, four (4) intermediate discharge openings 158*d* are radially disposed; however, the number of the intermediate discharge openings 158*d* may vary. The one or more intermediate discharge opening(s) 158*d* may pierce through the first ring-shaped wall 158 extending from its bottom to its top. The one or more intermediate discharge opening(s) 158*d* and the valve guide portion 158*b* may communicate with each other at a lower end of the back pressure plate 150. That is, a stepped portion 158*e* may be formed in a connection portion between the first ring-shaped wall 158 and the supporting plate 152. A discharged refrigerant may reach a space defined by the stepped portion 158*e*, and then move to the one or more intermediate discharge opening(s) 158*d*.

In some embodiments, the stepped portion 158*e* may be omitted, but rather, a communication hole by which the valve guide portion 158*b* and the intermediate discharge opening 158*d* may communicate with each other, may be provided. In any case, a refrigerant having passed through the discharge opening 145 may not be discharged to the one or more intermediate discharge opening(s) 158*d* if the check valve 108 is closed. Alternatively, the stepped portion 158*e* may be formed at or in the plate portion 143 of the second scroll 140, rather than on the back pressure plate 150.

The second ring-shaped wall 159 may be spaced from the first ring-shaped wall 158 by a predetermined distance, and a first sealing insertion groove 159*a* may be formed on an inner circumferential surface of the second ring-shaped wall 159. The first sealing insertion groove 159*a* may serve to receive and fix an O-ring 159*b*, to prevent leakage of a refrigerant from a contact surface to a floating plate 160, which is discussed hereinbelow. Alternatively, the first sealing insertion groove 159*a* may be formed on an outer circumferential surface of the floating plate 160. However, the first sealing insertion groove 159*a* formed on the floating plate 160 may be less stable than the first sealing insertion groove 159*a* formed on the back pressure plate 150, because the floating plate 160 continuously moves up and down.

A space having an approximately 'U'-shaped section may be formed by the first ring-shaped wall 158, the second ring-shaped wall 159, and the supporting plate 152. The floating plate 160 may be installed to cover the space. The floating plate 160 may have a ring shape, and may be configured to have an inner circumferential surface thereof face an outer circumferential surface of the first ring-shaped wall 158, and to have an outer circumferential surface thereof face an inner circumferential surface of the second ring-shaped wall 159. With such a configuration, the back pressure chamber (BP) may be implemented, and the aforementioned O-ring 159*b* and an O-ring 162*a* interposed between the respective facing surfaces may serve to prevent a refrigerant inside the back pressure chamber (BP) from leaking to the outside. Further, bolt accommodation portions 106*a*, which may prevent interference with the bolts 106, may be formed on a lower surface of the floating plate 160. However, in a case in which heads of the bolts 106 do not protrude from a surface of the supporting plate 152, the bolt accommodation portion 106*a* may be omitted.

A second sealing insertion groove 162 to receive and fix the O-ring 162*a* may be formed on the inner circumferential surface of the floating plate 160. The second sealing insertion groove 162 may be provided at or in the inner circumferential surface of the floating plate 160, whereas the first sealing insertion groove 159*a* may be formed at or in the second ring-shaped wall 159. This is because the first ring-shaped wall 158 may have an insufficient margin to process the grooves due to the valve guide portion 158*b* and the one or more intermediate discharge opening(s) 158*d* formed therein, and a diameter of the first ring-shaped wall 158 is smaller than a diameter the second ring-shaped wall 159. Alternatively, if the first ring-shaped wall 158 has a large diameter and a sufficient margin to process the grooves, the second sealing insertion groove 162 may be formed at or in the first ring-shaped wall 158.

A sealing end 164 may be provided at an upper end of the floating plate 160. The sealing end 164 may protrude upward from the surface of the floating plate 160, and may have an inner diameter large enough not to cover the one or more intermediate discharge opening(s) 158*d*. The sealing end 164 may contact a lower side surface of the discharge cover 102, thereby sealing the discharge path so that a discharged refrigerant may be discharged to the discharge space (D) without leaking to the suction space (S).

Hereinafter, an operation of the scroll compressor according to the above-described embodiment will be explained.

When power is supplied to the stator 112, the rotational shaft 116 may rotate. As the rotational shaft 116 rotates, the first scroll 130 fixed to the upper end of the rotational shaft 116 may perform an orbital motion with respect to the second scroll 140. As a result, the plurality of compression chambers formed between the wrap 144 and the wrap 134 may move toward the discharge opening 145, thereby compressing a refrigerant.

If the plurality of compression chambers communicate with the intermediate pressure discharge opening 147 before the refrigerant reaches the discharge opening 145, a portion of the refrigerant may be introduced into the intermediate pressure suction opening 153 of the supporting plate 152. Accordingly, an intermediate pressure may be applied to the back pressure chamber (BP) formed by the back pressure plate 150 and the floating plate 160. As a result, pressure may be applied downward to the back pressure plate 150, whereas pressure may be applied upward to the floating plate 160.

As the back pressure plate 150 may be coupled to the second scroll 140 by, for example, bolts, an intermediate pressure of the back pressure chamber (BP) may also influence the second scroll 140. The floating plate 160 may move upward because the second scroll 140 cannot move downward due to contact with the plate portion 132 of the first scroll 130. As the sealing end 164 contacts the lower end of the discharge cover 102, the floating plate 160 stops moving. Then, as the second scroll 140 is pushed toward the first scroll 130 by the pressure of the back pressure chamber (BP), the refrigerant may be prevented from leaking from a gap between the first scroll 130 and the second scroll 140.

If the pressure of the discharge opening 145 becomes higher than the pressure of the discharge space (D), the check valve 108 may move upward so that the refrigerant may be discharged to the space defined by the stepped portion 158*e*. Then, the refrigerant may be introduced into the one or more intermediate discharge opening(s) 158*d*, and may then be discharged to the discharge space (D). If the scroll compressor 100 is stopped or the pressure of the discharge space (D) temporarily increases, the check valve 108 may move downward to block the discharge opening 145. This may prevent counter rotation of the second scroll 140 resulting from backflow of the refrigerant.

If the scroll compressor 100 is stopped, pressure inside the back pressure chamber (BP) may decrease to reduce a pressing force on the second scroll 140 toward the first scroll 130. As a result, a load applied to the scroll compressor 100 when re-operating the scroll compressor 100 may be reduced. In this case, the floating plate 160 may move downward along the first ring-shaped wall 158.

The floating plate 160 may repeatedly move up and down due to the pressure applied to the back pressure chamber (BP) while the scroll compressor 100 operates. In order to smoothly move the floating plate 160 and to prevent leakage of refrigerant from a space between facing surfaces, a surface roughness of the first and second ring-shaped walls 158 and 159 to guide movement of the floating plate 160 should be very low.

In the conventional art, as the back pressure chamber (BP) is integrally formed with the second scroll 140, the inner surface of the back pressure chamber (BP) is formed of the same material as the fixed scroll 140, that is, cast iron. The cast iron has a limitation in reducing surface roughness and possesses low lubricity. However, in this embodiment, the second scroll 140 may be formed of cast iron as in the conventional art, whereas the back pressure plate 150 may be formed of a material, such as, aluminum alloy, carbon steel, or plating steel having more excellent surface roughness and processability than cast iron. With such a configuration, the surface roughness of the first and second ring-shaped walls 158 and 159, which contact and/or receive the floating plate 160 and the O-rings, may be enhanced to a desired and proper level. This may enhance lubrication characteristics and sealing performance of the scroll compressor 100.

In order to smooth the surface roughness, an entire portion of the second scroll 140 undergoes surface processing in the conventional art. This may lower workability and production efficiency. However, in this embodiment, only the back pressure plate 150 undergoes surface processing so that processability may be enhanced.

In the conventional art, the surface processing of the back pressure chamber (BP) should be performed while the second scroll 140 is fixed to a processing machine. This may cause deformation or damage to the plate portion or the wrap portion of the conventional scroll compressor 10. However, with this embodiment, only the back pressure plate 150 may be processed so that the second scroll 140 may be spared such deformation during processing.

The shape of the back pressure plate 150 is not limited to the illustrated example, but may vary.

Figure 7:
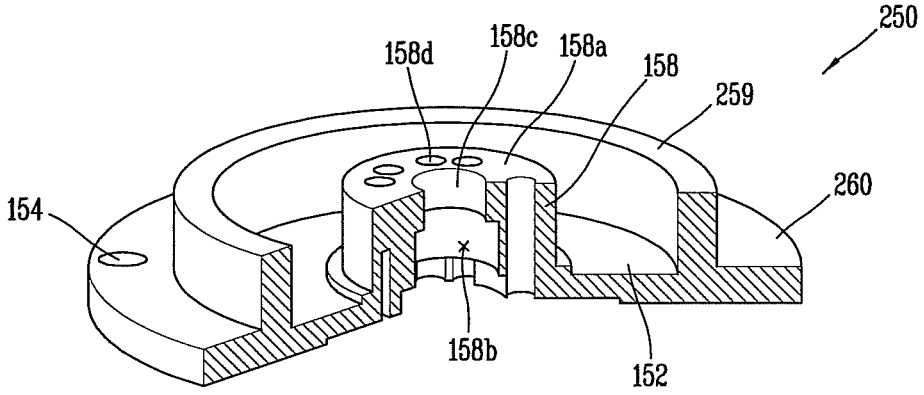
FIG. 7 is a partial cut-out view of a second scroll and a back pressure plate according to another embodiment.

FIG. 7 is a partial cut-out view of a second scroll and a back pressure plate according to another embodiment. The same components as those of the previous embodiment are provided with the same or like reference numerals, and repetitive disclosure has been omitted.

In FIG. 7, a second ring-shaped wall 259 of a back pressure plate 250 is inwardly spaced apart from an outer circumference of the supporting plate 152 by a predetermined distance. That is, the outer circumference of the supporting plate 152 may protrude toward the outside of the second ring-shaped wall 259, so as to form a flange 260. The bolt coupling holes 154 may be positioned at or on the flange 260.

With this embodiment, the number of through holes formed in the back pressure chamber (BP) may be reduced, and thus, a sealing performance further enhanced. Further, as bolt coupling parts are positioned near an outermost portion of the back pressure plate 250, an edge of the back pressure plate 250 may be prevented from being spaced from a surface of the second scroll 140.

Figure 8:
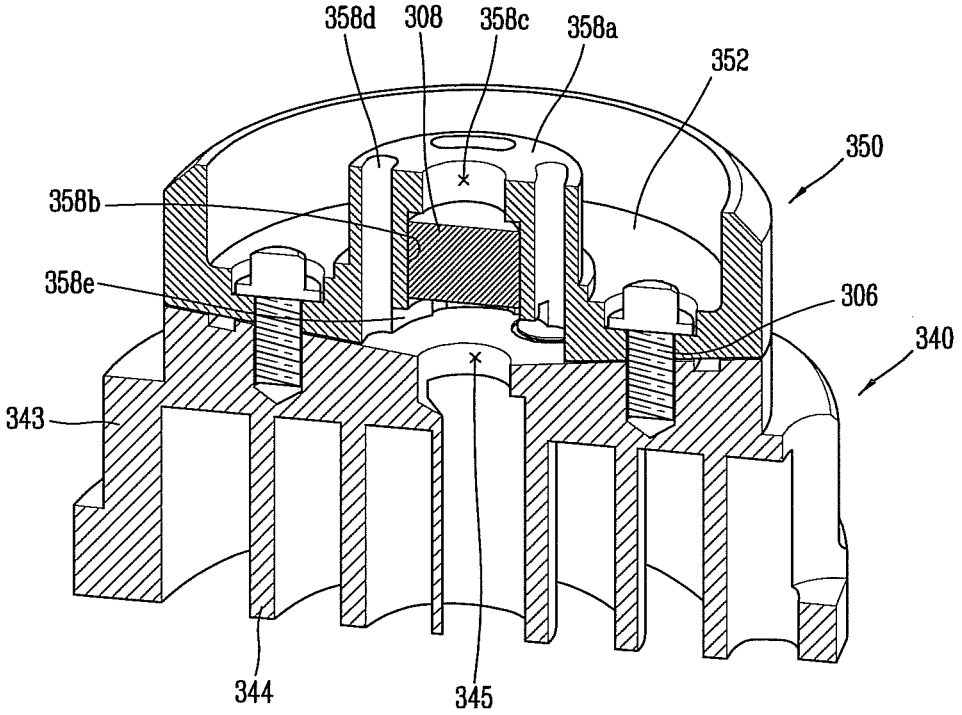
FIG. 8 is a partial cut-out view of a second scroll and a back pressure plate according to another embodiment.

FIG. 8 is a partial cut-out view of a second scroll and a back pressure plate according to another embodiment. This embodiment is differentiated from the previous embodiment in that facing surfaces of a back pressure plate 350 and a second scroll 340 are not planar, but rather, are 'V'-shaped when viewed from a side. With such a configuration, the back pressure plate 350 may be precisely aligned by the plate portion of the second scroll 340. As a result, the back pressure plate 350 need not be additionally aligned.

Embodiments disclosed herein provide a scroll compressor.

Embodiments disclosed herein provide a scroll compressor that may include a casing; a discharge cover fastened to the casing from within, the discharge cover dividing an inner space of the casing into a suction space and a discharge space; a main frame fastened to the casing from within, the main frame formed spaced apart from the discharge cover; a first or orbital scroll supported by the main frame and the orbital scroll configured to perform an orbital motion with respect to a rotational shaft of the orbital scroll in operation; a second or fixed scroll forming a suction chamber, an intermediate pressure chamber, and a discharge chamber together with the orbital scroll, the fixed scroll formed to be movable with respect to the orbital scroll; a back pressure plate fastened to the fixed scroll with a fastening means or device, the back pressure plate comprising a cavity with which the intermediate pressure chamber of the fixed scroll may communicate; and a floating plate movably coupled to the back pressure plate so as to seal an upper portion of the cavity, the floating plate comprising a back pressure chamber.

Embodiments disclosed herein provide a scroll that may include comprises a casing including a suction space and a discharge space; a first or orbital scroll configured to perform an orbital motion in operation; a second or fixed scroll formed to be movable within a limited range in the suction space with respect to the orbital scroll; and a back pressure chamber assembly fastened to an upper part of the fixed scroll with a fastening means or device to restrict movement of the fixed scroll, the back pressure chamber assembly being configured to press the fixed scroll toward the orbital scroll by introducing part of an operation fluid being compressed when the fixed scroll and the orbital scroll interact with each other, where at least part of the back pressure chamber assembly is formed of a material different from the fixed scroll.

Embodiments disclosed herein provide a scroll compressor that may include a casing; a discharge cover fixed to inside of the casing, and dividing the inside of the casing into a suction space and a discharge space; a main frame spaced from the discharge cover; a first or orbital scroll which performs an orbital motion in a supported state on the main frame; a second or fixed scroll installed to be movable up and down with respect to the orbital scroll, and forming a suction chamber, an intermediate pressure chamber and a discharge chamber together with the orbital scroll; a back pressure plate fixed to the fixed scroll below the discharge cover, and provided with a space portion of which upper part is open, the space portion communicating with the intermediate pressure chamber; and a floating plate movably coupled to the back pressure plate so as to seal the space portion, and forming a back pressure chamber.

The fixed scroll may be divided into a part including a back pressure chamber and a part including a wrap portion and a plate portion. The two parts may be coupled to each other by a coupling means or device. With such a configuration, in a case of processing a surface roughness into a desired level, only the part including the back pressure chamber, that is, the back pressure plate, may be additionally processed, without subjecting the part including the wrap portion and the plate portion to the surface roughness processing. Accordingly, the wrap portion and the plate portion may be saved from the deformation ensued from the surface roughness processing of the conventional scroll compressor. Further, the structure of the scroll compressor may facilitate a surface processing for enhancing lubricity.

The suction chamber, the intermediate pressure chamber, and the discharge chamber may be some of a plurality of compression chambers formed by the orbital scroll and the fixed scroll. More specifically, the suction chamber may refer to a compression chamber to which a refrigerant is sucked to start a compression operation. The discharge chamber, which may communicate with a discharge opening, may refer to a compression chamber where a discharge has just begun or is in the process. The intermediate pressure chamber, which may be disposed between the suction chamber and the discharge chamber, may refer to a compression chamber in which a compression operation is being processed.

The back pressure plate and the fixed scroll may be formed of different materials. Therefore, optimum materials may be selected for the back pressure plate and the fixed scroll. That is, the fixed scroll may be formed of cast iron having a low price and suitable for casting, as in the case of the conventional art. The back pressure plate of the back pressure chamber may be formed of aluminum alloy capable of enhancing surface roughness.

The back pressure plate may include a supporting plate of a ring shape, which may contact an upper surface of the fixed scroll, a first ring-shaped wall formed to enclose an inner space portion of the supporting plate, and a second ring-shaped wall disposed on an outer circumferential portion of the first ring-shaped wall. A plurality of bolt coupling holes may be formed at the supporting plate, and fixed scroll and the back pressure plate may be coupled to each other by bolts which pass through the bolt coupling holes.

The floating plate may have a ring shape. The floating plate and the back pressure plate may be coupled to each other so that an outer circumferential surface of the first ring-shaped wall may contact an inner circumferential surface of the floating plate, and an inner circumferential surface of the second ring-shaped wall may contact an outer circumferential surface of the floating plate.

An O-ring to seal a gap between the floating plate and the back pressure plate may be provided. First and second sealing insertion grooves to fix the O-ring may be provided. A first sealing insertion groove may be formed on an inner circumferential surface of the second ring-shaped wall of the back pressure plate, so that the O-ring is installed at or on a fixed member, rather than at or on a movable member. A second sealing insertion groove may be installed on an outer circumferential surface of the first ring-shaped wall. However, in the case of the first ring-shaped wall, installation of the second sealing insertion groove may not be easily achieved, as the first ring-shaped wall has a smaller thickness and a smaller diameter than the second ring-shaped wall. Therefore, in some cases, the second sealing insertion groove may be formed on an inner circumferential surface of the floating plate facing the first ring-shaped wall.

The second ring-shaped wall may be positioned on an outer circumferential surface of the supporting plate. That is, the back pressure plate may have a sectional surface of an approximate 'U'-shape.

The second ring-shaped wall may be disposed inwardly spaced apart from an outer circumferential surface of the supporting plate. That is, a flange may be formed outside the second ring-shaped wall. A plurality of bolt coupling holes may be formed on the supporting plate, outside the second ring-shaped wall in a radial direction, and the fixed scroll and the back pressure plate may be coupled to each other by bolts which pass through the bolt coupling holes.

A sealing means or seal may be installed at a contact surface between the back pressure plate and the fixed scroll. With such a configuration, a discharged refrigerant may be prevented from leaking from a gap between the back pressure plate and the fixed scroll.

The fixed scroll may include an intermediate pressure discharge opening that communicates with the intermediate pressure chamber, and the back pressure plate may include an intermediate pressure suction opening that communicates with the intermediate pressure discharge opening. With such a configuration, an intermediate pressure may be applied into the back pressure chamber. A sealing means or seal may be provided so as to prevent leakage of a refrigerant from a gap between the intermediate pressure discharge opening and the intermediate pressure suction opening.

A check valve may be provided so as to prevent a refrigerant inside a discharge space from backflowing to the fixed scroll. An inner space of the first ring-shaped wall may form part of a discharge path that connects a discharge opening of the fixed scroll to the discharge space. In this case, the check valve may be installed at or in the inner space of the first ring-shaped wall, and may be slidable up and down.

The refrigerant discharged from the discharge opening may be discharged to the discharge space, via a space between an inner circumferential surface of the first ring-shaped wall and the check valve. An intermediate discharge opening to discharge the refrigerant discharged to the inner space of the first ring-shaped wall into the discharge space may be formed on an upper surface of the first ring-shaped wall. The intermediate discharge opening may be arranged radially on the upper surface of the first ring-shaped wall.

Embodiments disclosed herein provide a scroll compressor that may include a casing having a suction space and a discharge space; a second or scroll installed to be movable in the suction space with respect to a first or orbital scroll, within a limited range; and a back pressure chamber assembly coupled to an upper part of the fixed scroll to restrict an up-down motion of the fixed scroll, and configured to press the fixed scroll toward the orbital scroll by introducing part of an operation fluid being compressed as the fixed scroll and the orbital scroll interact with each other. At least part of the back pressure chamber assembly may be formed of a different material from the fixed scroll.

The fixed scroll may include a plate portion having an intermediate pressure discharge opening through which part of the operation fluid may be discharged toward the back pressure chamber assembly and a wrap portion spirally formed at the plate portion. The back pressure chamber assembly may include a back pressure plate having a space portion that communicates with the intermediate pressure discharge opening and a floating plate that forms a back pressure chamber by sealing the space portion of the back pressure plate.

The scroll compressor according to embodiments may have at least the following advantages.

First, only the back pressure plate may be processed to smooth out its surface roughness, as the fixed scroll is physically divided into a part including the back pressure chamber and a part including the wrap portion and the plate portion. Accordingly, the wrap portion and plate portion may not be subjected to the processing to smooth out the surface roughness, hence eliminating the chance of them being deformed by the surface processing.

Further, as only the back pressure plate undergoes additional surface processing, the same goal may be achieved at a lower cost than a conventional case where the fixed scroll, which includes the back pressure plate, the wrap portion, and plate portion, in entirety undergoes the surface processing.

Further, as the back pressure plate and the fixed scroll are formed of different materials, an optimum material for each part may be selected.

Further, when the back pressure plate is separated from the fixed scroll, the plate portion of the fixed scroll may be exposed to the outside. Therefore, in a case in which pressure of the intermediate pressure chamber increases excessively, a bypass valve to bypass the pressure to the discharge space may be easily installed. Further, in a case in which pressure inside the back pressure chamber increases excessively, a back pressure discharge path to discharge the pressure to the discharge space may be easily installed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a discharge cover, the discharge cover dividing an inner space of the casing into a suction space and a discharge space;

a main frame, the main frame being spaced apart from the discharge cover;

a first scroll supported by the main frame, the first scroll being configured to perform an orbital motion with respect to a rotational shaft in operation;

a second scroll forming a suction chamber, an intermediate pressure chamber, and a discharge chamber together with the first scroll, the second scroll being movable with respect to the first scroll;

a back pressure plate coupled to the second scroll, the back pressure plate comprising a cavity with Which the intermediate pressure chamber of the second scroll communicates, a lower surface of the back pressure plate facing an upper surface of the second scroll; and a floating plate movably coupled to the back pressure plate so as to seal an upper portion of the cavity, wherein the back pressure plate and the second scroll are formed of different materials.

2. The scroll compressor of claim 1, wherein the second scroll is formed of cast iron, and the back pressure plate is formed of steel or aluminum alloy.

3. The scroll compressor of claim 1, wherein the hack pressure plate comprises:

a supporting plate, the supporting plate contacting the upper surface of the second scroll;

a first ring-shaped wall formed to enclose an inner space; and a second ring-shaped wall disposed at an outer circumference of the first ring-shaped wall.

4. The scroll compressor of claim 3, wherein the supporting plate is ring-shaped.

5. The scroll compressor of claim 3, further comprising a plurality of bolt coupling holes formed in the supporting plate, wherein the second scroll and the back pressure plate are fastened by a corresponding number of bolts, which pass through the plurality of bolt coupling holes.

6. The scroll compressor of claim 3, wherein the floating plate is ring-shaped.

7. The scroll compressor of claim 6, wherein the floating plate and the back pressure plate are coupled such that an outer circumferential surface of the first ring-shaped wall contacts an inner circumferential surface of the floating plate and an inner circumferential surface of the second ring-shaped wall contacts an outer circumferential surface of the floating plate.

8. The scroll compressor of claim 7, further comprising a first sealing insertion groove formed on the inner circumferential surface of the second ring-shaped wall.

9. The scroll compressor of claim 8, further comprising a second sealing insertion groove formed on the inner circumferential surface of the floating plate.

10. The scroll compressor of claim 3, wherein the second ring-shaped wall is disposed adjacent an outer circumferential surface of the supporting plate.

11. The scroll compressor of claim 3, wherein the second ring-shaped wall is spaced inwardly from an outer circumferential surface of the supporting plate.

12. The scroll compressor of claim 11, further comprising a plurality of bolt coupling holes formed on the supporting plate outside the second ring-shaped wall in a radial direction, wherein the second scroll and the back pressure plate are fastened by a corresponding number of bolts, which pass through the plurality of bolt coupling holes.

13. The scroll compressor of claim 11, further comprising a seal installed at a contact surface between the back pressure plate and the second scroll.

14. The scroll compressor of claim 3, further comprising:

a check valve installed at the inner space of the first ring-shaped wall, the check valve being configured to prevent a refrigerant of the discharge space from backflowing to the discharge chamber using a pressure difference between the discharge space and the discharge chamber;

a valve guide formed at the inner space of the first ring-shaped wall to guide movement of the check valve; and at least one intermediate discharge opening configured to allow flow of the refrigerant discharged from the discharge chamber to the e discharge space.

15. The scroll compressor of claim 14, wherein the at least one intermediate discharge opening is formed radially outside of the valve guide.

16. The scroll compressor of claim 14, wherein the at least one intermediate discharge opening and the valve guide communicate at a lower portion of the first ring-shaped wall.

17. The scroll compressor of claim 1, wherein the second scroll comprises an intermediate pressure discharge opening that communicates with the intermediate pressure chamber, and wherein the back pressure plate comprises an intermediate pressure suction opening that communicates with the intermediate pressure discharge opening.

18. The scroll compressor of claim 17, further comprising a seal installed to prevent leakage of a refrigerant from a gap between the intermediate pressure discharge opening and the intermediate pressure suction opening.

19. A scroll compressor, comprising:

a casing comprising a suction space and a discharge space;

a first scroll configured to perform an orbital motion in operation;

a second scroll movable within a limited range in the suction space with respect to the first scroll; and a back pressure chamber assembly comprising a back pressure plate and a floating plate, the back pressure chamber assembly being configured to press the second scroll toward the first scroll, wherein the back pressure plate is formed of a material different from the second scroll.

20. The scroll compressor of claim 19, wherein the second scroll is formed of cast iron, and the back pressure plate is formed of steel or aluminum alloy.

21. The scroll compressor of claim 19, wherein the back pressure plate comprises:

a supporting plate, the supporting plate contacting an upper surface of the second scroll;

a first ring-shaped wall formed to enclose an inner space; and a second ring-shaped wall disposed at an outer circumference of the first ring-shaped wall.

22. The scroll compressor of claim 19, wherein the second scroll comprises:

a plate portion having an intermediate pressure discharge opening through which a portion of an operation fluid is discharged toward the back pressure chamber assembly; and a wrap portion spirally formed on the plate portion.

23. The scroll compressor of claim 22, wherein the back pressure chamber assembly comprises:

the back pressure plate comprising a space that communicates with the intermediate pressure discharge opening; and the floating plate forming a back pressure chamber by sealing the space.

24. The scroll compressor of claim 23, wherein the hack pressure plate comprises:

a supporting plate, the supporting plate contacting an upper surface of the second scroll;

a first ring-shaped wall formed to enclose an inner space; and a second ring-shaped wall disposed at an outer circumference of the first ring-shaped wall.

25. The scroll compressor of claim 24, wherein the supporting plate ring-shaped.

26. The scroll compressor of claim 24, wherein the floating plate is ring-shaped.

27. The scroll compressor of claim 26, wherein the floating plate and the back pressure plate are coupled such that an outer circumferential surface of the first ring-shaped wall contacts an inner circumferential surface of the floating plate and an inner circumferential surface of the second ring-shaped wall contacts an outer circumferential surface of the floating plate.

28. The scroll compressor of claim 19, wherein the second scroll comprises an intermediate pressure discharge opening that communicates with the intermediate pressure chamber, and wherein the back pressure plate comprises an intermediate pressure suction opening that communicates with the intermediate pressure discharge opening.

29. The scroll compressor of claim 28, further comprising a seal installed to prevent leakage of a refrigerant from a gap between the intermediate pressure discharge opening and the intermediate pressure suction opening.

30. A scroll compressor, comprising:

a casing;

a discharge cover, the discharge cover dividing an inner space of the casing into a suction space and a discharge space;

a main frame, the main frame being spaced apart from the discharge cover;

a first scroll supported by the main frame, the first scroll being configured to perform an orbital motion with respect to a rotational shaft in operation;

a second scroll forming a suction chamber, an intermediate pressure chamber, and a discharge chamber together with the first scroll, the second scroll being movable with respect to the first scroll;

a back pressure plate fastened to the second scroll by at least one fastener, the back pressure plate having a hole configured to receive the at least one fastener, and comprising a cavity with which the intermediate pressure chamber of the second scroll communicates; and a floating plate movably coupled to the back pressure plate so as to seal an upper portion of the cavity, wherein the back pressure plate and the second scroll are formed of different materials.

31. The scroll compressor of claim 30, wherein the second scroll is formed of cast iron, and the back pressure plate is formed of steel or aluminum alloy.

32. The scroll compressor of claim 30, wherein the back pressure plate comprises:

a supporting plate, the supporting plate contacting an upper surface of the second scroll;

a first ring-shaped wall formed to enclose an inner space; and a second ring-shaped wall disposed at an outer circumference of the first ring-shaped wall.

33. The scroll compressor of claim 32, wherein the supporting plate is ring-shaped.

34. The scroll compressor of claim 32, wherein a plurality of bolt coupling holes is formed in the supporting plate, wherein the at least one fastener comprises a corresponding number of bolts, and wherein the second scroll and the back pressure plate are fastened by the corresponding number of bolts, which pass through the plurality of bolt coupling holes.

35. The scroll compressor of claim 34, Wherein the floating plate and the back pressure plate are coupled such that an outer circumferential surface of the first ring-shaped wall contacts an inner circumferential surface of the floating plate and an inner circumferential surface of the second ring-shaped wall contacts an outer circumferential surface of the floating plate.

36. The scroll compressor of claim 32, wherein the floating plate is ring-shaped.

37. The scroll compressor of claim 32, wherein the second ring-shaped wall is spaced inwardly from an outer circumferential surface of the supporting plate.

38. The scroll compressor of claim 37, wherein a plurality of bolt coupling holes is formed on the supporting plate outside the second ring-shaped wall in a radial direction, wherein the at least one fastener comprises a corresponding number of bolts, and wherein the second scroll and the back pressure plate are fastened by the corresponding number of bolts, which pass through the plurality of bolt coupling holes.

39. The scroll compressor of claim 37, further comprising a seal installed at a contact surface between the back pressure plate and the second scroll.

* * * * *